US007036764B2

(12) United States Patent
Granger et al.

(10) Patent No.: US 7,036,764 B2
(45) Date of Patent: May 2, 2006

(54) DISPENSER FOR WIPING MATERIAL AND SIMILAR PRODUCTS

(76) Inventors: Maurice Granger, 17 Rue Marcel Pagnol, Saint Priest en Jarez (FR) F-42270; Daniel Granger, La Tranchais, Saint Germain de Princay (FR) F-85110; Sabine Granger, 4 Square Violette, Saint Etienne (FR) F-42000; Sméralda Granger, 8 Rue Praire, Saint Etienne (FR) F-42000

( * ) Notice: Subject to any disclaimer, the term of this patent is extended or adjusted under 35 U.S.C. 154(b) by 0 days.

(21) Appl. No.: 10/897,938

(22) Filed: Jul. 23, 2004

(65) Prior Publication Data

US 2005/0072875 A1 Apr. 7, 2005

Related U.S. Application Data

(63) Continuation of application No. PCT/FR02/04447, filed on Dec. 19, 2002.

(30) Foreign Application Priority Data

Feb. 1, 2002 (FR) ..... 02 01436

(51) Int. Cl.
*A47K 10/36* (2006.01)
*A47K 10/38* (2006.01)

(52) U.S. Cl. ..... 242/564.5; 83/337; 83/649; 242/596.8

(58) Field of Classification Search ..... 242/564.5, 242/596.1, 596.3, 596.8; 83/203, 205, 222, 83/322, 334, 335, 337, 422; 225/649, 10, 225/15, 16, 39, 42, 46, 47; 312/34.19, 34.21, 312/34.22, 34.24
See application file for complete search history.

(56) References Cited

U.S. PATENT DOCUMENTS

| | | | | |
|---|---|---|---|---|
| 2,169,399 | A | 8/1939 | Steiner | |
| 3,167,367 | A * | 1/1965 | Rozlog et al. | 242/564.4 |
| 3,998,120 | A * | 12/1976 | Granger et al. | 83/335 |
| 4,699,304 | A * | 10/1987 | Voss et al. | 226/129 |
| 5,294,192 | A * | 3/1994 | Omdoll et al. | 242/560.1 |
| 5,979,822 | A | 11/1999 | Morand et al. | 242/564.2 |
| 6,138,939 | A * | 10/2000 | Phelps et al. | 242/596.7 |

* cited by examiner

*Primary Examiner*—Kathy Matecki
*Assistant Examiner*—Scott Haugland
(74) *Attorney, Agent, or Firm*—Heslin Rothenberg Farley & Mesiti P.C.

(57) ABSTRACT

A dispenser has an autonomous unit comprising: a roll dispenser for dispensing a roll of material, a cutting drum, and side panels. A rear profile of the side panels comprises an edge and corresponds to an internal profile of a case. A lower part of a lower face of said edge extends into a tongue which can be locked and positioned in a housing. The housing is formed by the front part of the base wall of the case for rails, which are used to position the lower edges of the side panels. The upper parts of the side panels are formed with an elastic tongue. Each tongue receives a shaped locking tab which is positioned behind tabs that form hooks on a rear face of the case.

5 Claims, 4 Drawing Sheets

Figure 1:
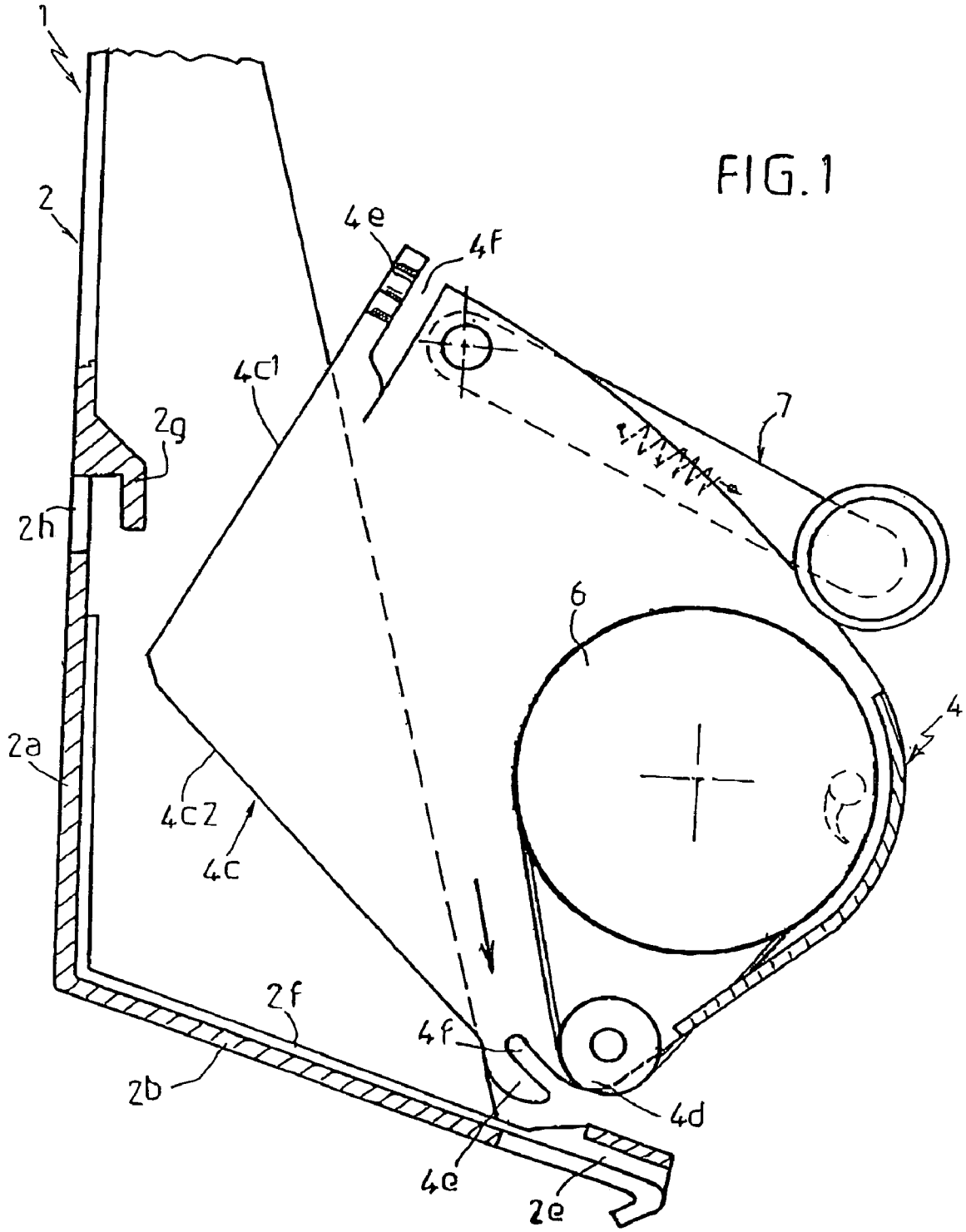

7
2g
4e
2h
4f
5
4
3
2a
6
4b
2f
2b
2e

DISPENSER FOR WIPING MATERIAL AND SIMILAR PRODUCTS

CROSS-REFERENCE TO RELATED APPLICATIONS

This application is a continuation of international application PCT/FR02/04447 filed Dec. 19, 2002 and published, in French, as international publication number WO 03/063670 A1 on Aug. 7, 2003, and claims priority from French patent application number 02/01436 filed Feb. 1, 2002, the full contents of these applications being incorporated by reference herein.

The invention relates to the technical field of dispensing machines which include an automatic cutting system for wipe material made of tissue paper, paper and similar products.

The Applicant has developed many dispensing machines of this type which include, firstly, a housing with a protective cover, a unit which accommodates a drum with a cutting device, and various mechanisms allowing rotation and monitoring of the drum and, secondly, a reel of material mounted on support end shields and located in the upper part of the housing. For example, French Patent No. 2.266.650 describes a drum support and mechanism carrier unit and a reel-holder arm, both these means being separately mounted and snapped into matching shapes in the rear wall of the housing. In this embodiment, the walls of the housing have protruding punched tabs capable of cooperating with other matching tabs formed on the bottom wall of the mechanism carrier unit. There is also provision, in a machine of this type, for the front of the mechanism carrier unit to have protruding tabs capable of fitting into and engaging in a shaped border which forms a hollow along the front longitudinal surface of the plain wall of the housing.

These arrangements enable modular assembly of the mechanism carrier unit and the reel-holder arm. Openings are also provided for the latter on the wings of the housing in order to install a retention shaft.

This embodiment was devised by the Applicant when the housing was made of a metal and it was easy to cut out shapes in order to profile them as a tab in order to allow the above-mentioned connections. However, it was found that assembly was not always practical, especially assembly of the mechanism carrier unit. In fact, fitting the mechanism carrier unit made it necessary for said unit to swivel and pivot in order to insert the opposite-facing profiled tabs on the bottom wall of the unit and on the housing, these being positioned one underneath the other, with the risk of the tab or tabs catching or being bent. In addition, in this embodiment, the reel holder was independent of the mechanism carrier unit. This necessitated two assembly operations.

As part of its ongoing research, the Applicant modified the design of the dispensing machine by integrating, as a single module, all the necessary means for transporting and cutting the strip of material as well as means of supporting the reel of material.

In other words, the invention aims to produce a single module which supports all the necessary means for dispensing and cutting the material.

The invention therefore aims to make a specific particular modification to the housing which accommodates all the mechanisms and the module in particular.

According to a first aspect, the machine for dispensing wipe material and similar products of the type comprising a self-contained module which accommodates the necessary means and mechanisms for dispensing the reel of material and a drum with an associated cutting device, the module comprising two lateral end shields between which said means and mechanisms, drum and reel holder are located, the end shields having a rear profile with an edge which matches the internal profile of the housing, the lower part of said lower edge extending as a tongue capable of fitting into and positioning itself in a hollow cavity which accommodates and retains the fork and is formed on the front part of the wall of the bottom of the housing and rails produced by moulding and located on a bottom surface of the housing along an extension of said cavity which ensures positioning of the lower edges of the end shields and in that the upper part of the end shields are made with a tongue which is capable of elastic deformation, each tongue accommodating a profiled locking tab which fits behind tabs which form hooks on the rear surface of the housing.

These aspects and others will become apparent from the following description.

Figure 2:
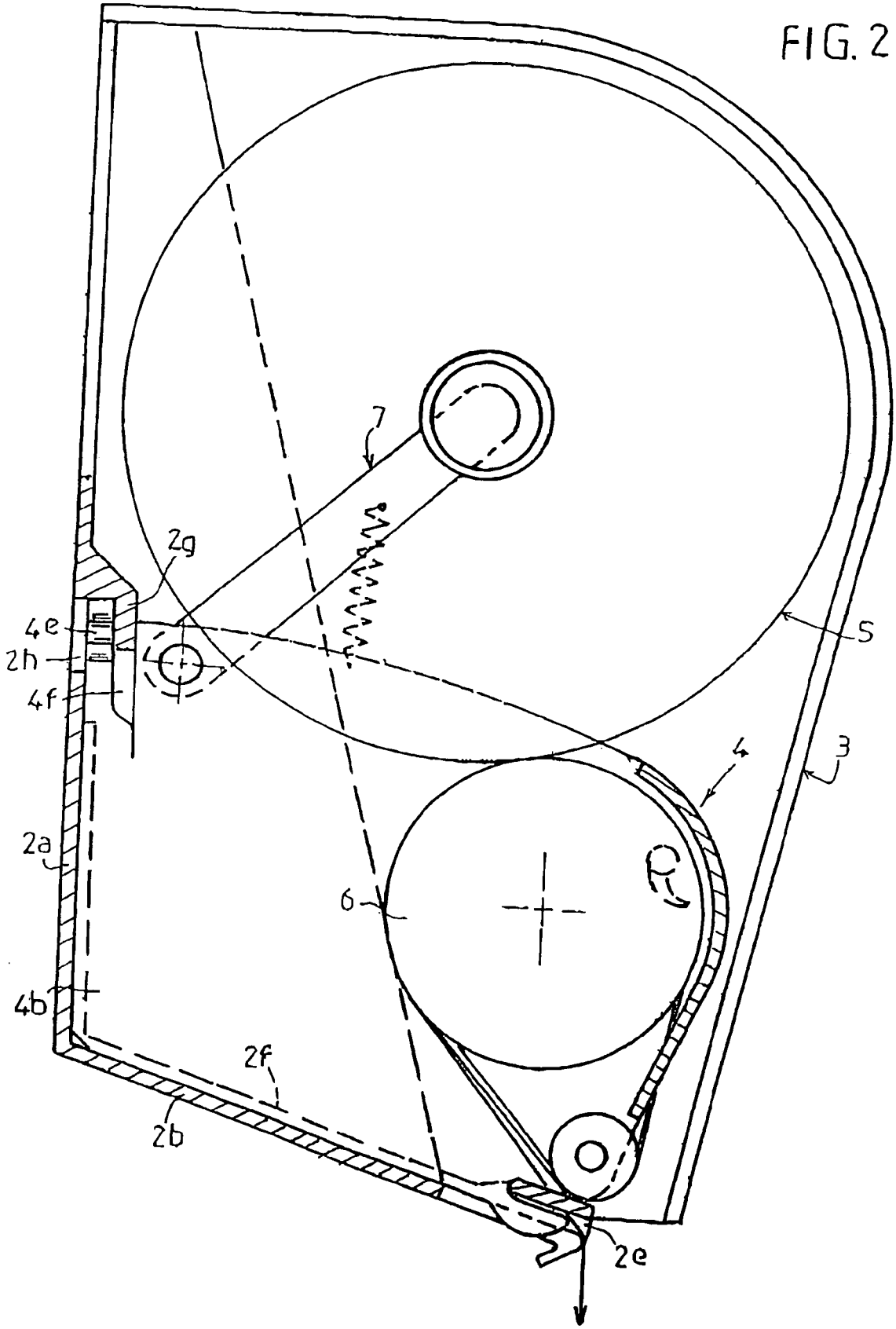
Figure 3:
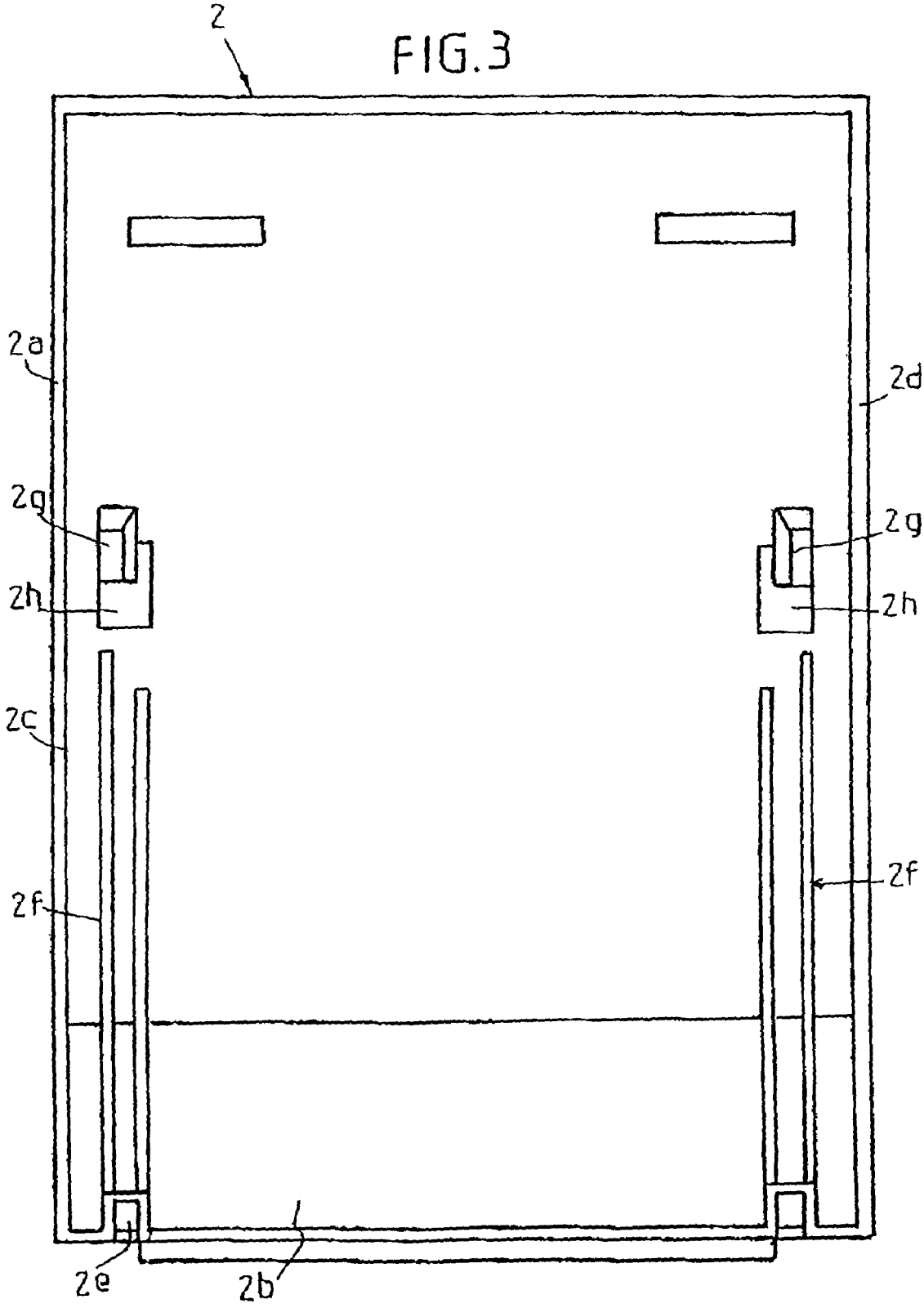
Figure 4:
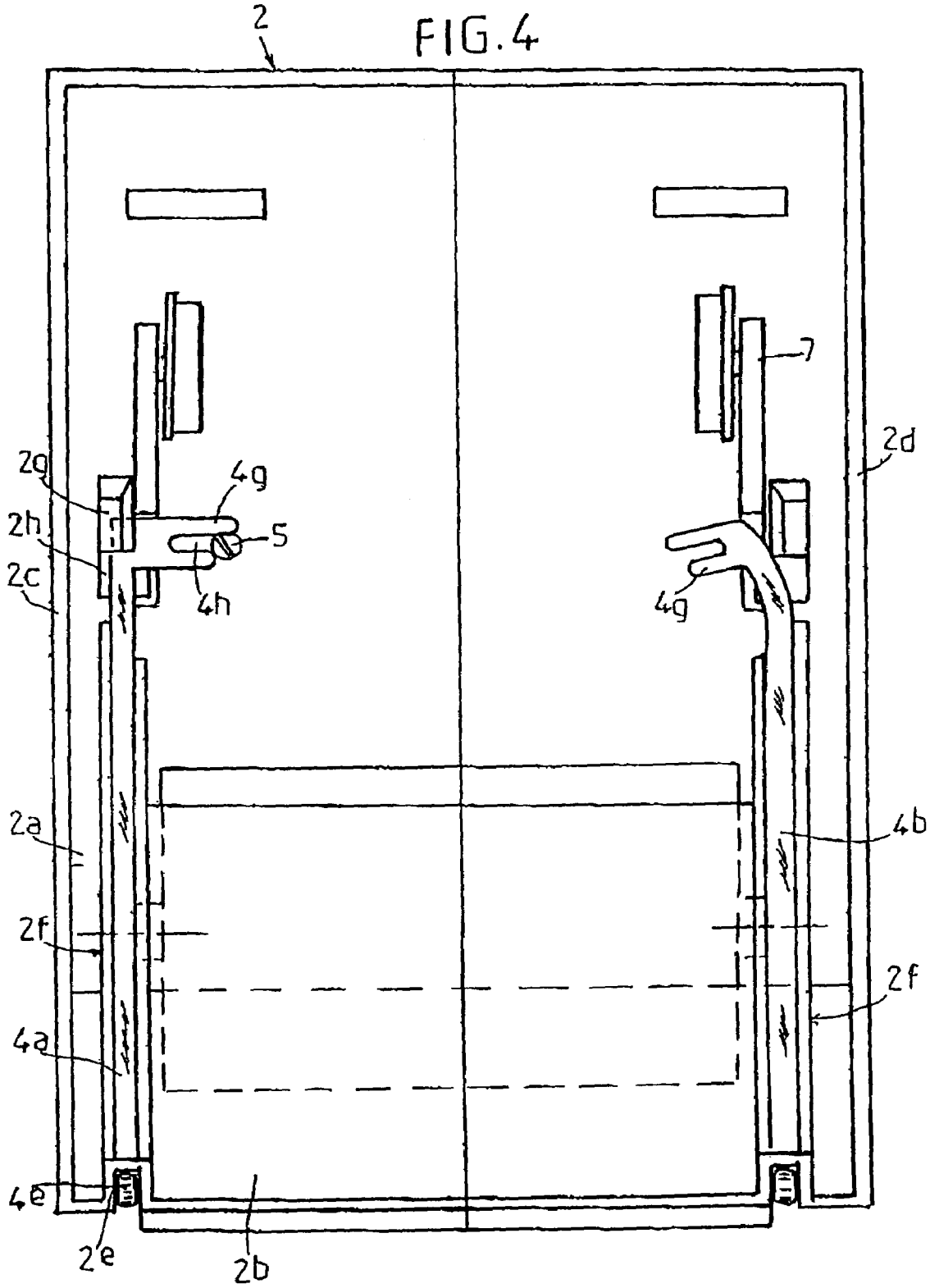

The object of the present invention is described in greater detail in the accompanying drawings in which:

FIG. 1 is a cutaway profile view of a wipe material dispensing machine which includes a module intended to be mounted on a housing, FIG. 2 is a view similar to FIG. 1 with the module shown after it has been mounted on the housing, FIG. 3 is a front view of the housing with the module not in position, FIG. 4 is a front view of the housing of the machine with the module in position. This Figure shows, in two halves, said machine and highlights the means of locking the module in position and swivelling the module on the housing.

In order that the present invention may more readily be understood, the following description is given, merely by way of example, reference being made to the accompanying drawings.

The dispensing machine for wipe material, tissue paper, paper and similar materials is referred to in its entirety as (1). It comprises a housing (2) capable of accommodating an articulated cover (3). This housing (2) has a vertical rear surface (2*a*), a slanting lower bottom surface (2*b*) and two lateral wings (2*c*–2*d*). According to the invention, the housing thus described is modified to accommodate and mount a self-contained module (4) capable of accommodating the necessary means and mechanisms for dispensing the reel (5) of material and a drum (6) with an associated cutting device. The reel of material can be designed with support means (7) so that it comes into contact with the drum or it can be kept away from the drum so that it does not rest on it.

All the special arrangements of the above-mentioned mechanisms have no impact on the object of this invention. They can be varied as disclosed in the various patents which the Applicant has filed.

The invention essential aims to attach the mechanism carrier and reel holder module (4) to the housing. The module comprises two lateral end shields (4*a*–4*b*) between which the various above-mentioned mechanisms, drum and reel holder are located. These end shields (4*a*–4*b*) have a rear profile with an edge (4*c*) which has two flats (4*c*1–4*c*2) which match the internal profile of the housing so that the shapes fit together. The lower part of the lower edge (4*c*2) extends as a profiled tongue (4*e*) which defines a slit (4*f*) with the lower end (4*d*) of the end shields in question and forms a fork shape. The latter is capable of fitting in and positioning itself in a hollow cavity (2*e*) to retain the fork which is formed in the front part of the bottom wall of the housing. Rails (2*f*) are moulded and located on a bottom surface of the housing along an extension of said cavity (2*e*) in order to accommodate and ensure the positioning of the lower edges of the above-mentioned end shields (4*a*–4*b*).

In addition, the upper part of the end shields (4*a*–4*b*) is shaped with a tongue (4*e*) which is bounded by a vertical slit (4*f*) with the body of the end shield in order to allow positioning with a certain degree of elasticity. These tongues (4*e*) also accommodate, in a perpendicular plane, two profiled tabs (4*g*) which face each other and fulfil a locking function. On the rear surface (2*a*) of the housing, there are two tabs which form hooks (2*g*) which are intended to face and enable positioning and deflection of locking tabs (4*g*) formed on above-mentioned end shields. The locking tabs (4*g*) swivel downwards in a plane which is parallel to that of the rear surface of the housing and are longer than the width of the hook tabs (2*g*). They ensure lateral locking in position.

The rear surface (2*a*) of the housing has, opposite said tabs which form hooks (2*g*), mould-release openings (2*h*).

Additional screws (5) can be separately mounted between the fork shapes (4*h*) formed on the locking tabs (4*g*) to ensure secure connection.

It is apparent, according to the invention, that the module and the housing thus designed will be capable of being assembled by quick fixing. End shields (4*a*–4*b*) are themselves positioned more rigidly by gripping onto the mounting rails. The locking tabs (4*g*) are capable of swivelling, due to elasticity, when the module is fitted on the housing and then, after release, they are positioned behind the hook-shape tabs (2*g*).

This structure allows quick assembly of the module on the housing and locking in position. Manipulation by the operator is straightforward.

The arrangements of the module are irrelevant.

The invention claimed is:

1. Machine for dispensing wipe material and similar products comprising a housing, a protective cover, and a self-contained module which accommodates means for dispensing a reel of material and a drum with an associated cutting device, the module comprising two lateral end shields between which the means for dispensing, the drum and a material reel holder are located, the end shields having a rear profile with an edge which matches an internal profile of the housing, a lower part of a lower flat of a lower edge of at least one of the end shields extending as a first tongue for fitting into and positioning itself in a cavity formed on a front part of a bottom wall of the housing, and rails located on a bottom surface of the housing forming a groove that forms an extension of the cavity and ensuring positioning of the lower edge of said at least one of the end shields, and an upper part of at least one of the end shields is provided with a second capable of elastic deformation, each second having a profiled locking tab which fits behind a hook which forms a hook on a rear surface of the housing, and wherein the locking tab swivels in a plane parallel to that of a rear surface of the housing and is longer than a width of the hook tab and ensures lateral locking in place.

2. Machine for dispensing wipe material and similar products as claimed in claim 1, wherein each second tomgue is bounded by a vertical slit in a body of the end shield.

3. Machine for dispensing wipe material and similar products as claimed in claim 1, wherein each locking tab has at an end, a fork shape in order to accommodate and position a fixing screw.

4. Machine for dispensing wipe material and similar products as claimed in claim 1, wherein the rails are produced by moulding.

5. Machine for dispensing wipe material and similar products as claimed in claim 1, wherein each of said end shields is provided with a said second tongue.

* * * * *

UNITED STATES PATENT AND TRADEMARK OFFICE

CERTIFICATE OF CORRECTION

PATENT NO. : 7,036,764 B2
APPLICATION NO. : 10/897938
DATED : May 2, 2006
INVENTOR(S) : Granger et al.

It is certified that error appears in the above-identified patent and that said Letters Patent is hereby corrected as shown below:

Claims:

Claim 1

Col. 4, line 15, insert the word --tongue-- after the word “second” in the first instance Col. 4, line 15, insert the word --tongue-- after the word “second” in the second instance Col. 4, line 17, inser the word --tab-- afer the word “hook”

Signed and Sealed this

Fourteenth Day of November, 2006

JON W. DUDAS
*Director of the United States Patent and Trademark Office*